US005373969A

United States Patent [19]

Takemura

[11] Patent Number: 5,373,969

[45] Date of Patent: Dec. 20, 1994

[54] CONTAINER HAVING MEANS FOR PREVENTING REFILLING

[75] Inventor: Toru Takemura, Tokyo, Japan

[73] Assignee: Riso Kagaku Corporation, Tokyo, Japan

[21] Appl. No.: 91,204

[22] Filed: Jul. 14, 1993

[30] Foreign Application Priority Data

Jul. 16, 1992 [JP] Japan ..... 4-189058

[51] Int. Cl.[5] ..... B65D 47/02

[52] U.S. Cl. ..... 222/147; 222/327; 222/386

[58] Field of Search ..... 222/147, 327, 386

[56] References Cited

U.S. PATENT DOCUMENTS

| | | | |
|---|---|---|---|
| 996,055 | 6/1911 | Broad | 222/147 |
| 1,599,660 | 9/1926 | Little et al. | 222/147 X |
| 4,657,161 | 4/1987 | Endo et al. | 222/386 X |
| 4,792,065 | 12/1988 | Soehnlein et al. | 222/386 X |
| 4,949,875 | 8/1990 | Kuo | 222/327 X |
| 5,150,823 | 9/1992 | Sugita | 222/386 |
| 5,178,305 | 1/1993 | Keller | 222/386 |

FOREIGN PATENT DOCUMENTS

| | | | |
|---|---|---|---|
| 0351441 | 1/1990 | European Pat. Off. | 222/327 |

OTHER PUBLICATIONS

Patent Abstracts of Japan, vol. 10, No. 055 (M-458) 5 Mar. 1986 (JP-A-60 204 355).

*Primary Examiner*—David M. Mitchell
*Assistant Examiner*—Kenneth Bomberg
*Attorney, Agent, or Firm*—Dickstein, Shapiro & Morin

[57] ABSTRACT

In a container, which is required to prevent refilling for security and other reasons, and comprises a tubular container main body having one end thereof closed by an end wall, the end wall being provided with a content taking outlet, and a piston member slidably received in the container main body, defining a containing chamber between the piston member and the end wall, a cap member closing an opening provided in the piston member is detachably mounted on the piston member, and the container main body is provided with a cap engaging member which irreversibly engages with the cap member when the piston member has approached the end wall by more than a prescribed distance. As a result, when an attempt is made to refill the container, the content will escape from this opening, and such an attempt can be thereby effectively prevented. Alternatively, the container main body and the piston member may be provided with claws which engage with each other when the piston member has reached its stroke end so that any further movement of the piston member may be prohibited, and an attempt to refill the container may be prevented.

6 Claims, 4 Drawing Sheets

CONTAINER HAVING MEANS FOR PREVENTING REFILLING

TECHNICAL FIELD

The present invention relates to a container having means for preventing refilling, and in particular to a structure for preventing refilling in a cylinder/piston type container.

BACKGROUND OF THE INVENTION

In some applications of containers such as ink cartridges for printers, it is desirable to incorporate the container with means for preventing contents other than the originally intended content to be refilled in the container once the original content is filled into the container, and is subsequently used up, for security reasons, and for ensuring the proper operation of the machinery to which the container supplies its content.

In most applications, such means for preventing refilling would be acceptable only when its structure is simple enough to be suitable for use as disposable containers or throw-away cartridges.

BRIEF SUMMARY OF THE INVENTION

In view of such considerations, a primary object of the present invention is to provided a container having means for preventing refilling which can be used as cylinder/piston type containers without requiring any complex structure, and is simple enough to be used as a disposable container.

A second object of the present invention is to provide a container having means for preventing refilling which in no way detract from the normal handling of the container.

A third object of the present invention is to provide a container having means for preventing refilling which creates no problem during the process of initially filling it with a content.

A fourth object of the present invention is to provide a container having means for preventing refilling which is suitable for use as an ink cartridge of a stencil printer.

These and other objects of the present invention can be accomplished by providing a container having means for preventing refilling, comprising: a tubular container main body having one end closed by an end wall provided with a content taking out opening; a piston member slidably received in the container main body so as to define a containing chamber between the piston member and the end wall; a cap member detachably mounted on the piston member and closing an opening provided in the piston member, the opening communicating the containing chamber with an external part; and cap engaging means provided in the container main body for engaging the cap member when the piston member has approached the end wall by more than a prescribed distance.

According to this structure employing the cap engaging member, when the piston member has approached the end wall of the container main body by more than a prescribed distance, the cap engaging member irreversibly engages the cap member. If an attempt is made to refill a content into the containing chamber of the container main body in this condition, as the piston member moves away from the end wall as a result of such a refilling action, the cap member is disengaged from the piston member, and opens up the opening in the piston member thereby causing the content to escape from this opening and rendering the refilling of the content impossible.

The cap member may comprise a breakable part for preventing intact disengagement of the cap member from the cap engaging means. Preferably, the cap member comprises a tubular side wall, and a bottom portion closing one end of the tubular side wall, the bottom portion including a breakable thin-walled portion so that an attempt to disengage the cap member by inserting a rod or the like from the content taking out opening, and pushing the cap member may be foiled by resulting in the destruction of the cap member. According to a preferred embodiment of the present invention, the cap member comprises a tubular side wall, and a bottom portion closing one end of the tubular side wall, the side wall including a substantially annular breakable thin-walled portion. Alternatively, the side wall may include a substantially annular breakable thin-walled portion.

According to a preferred embodiment of the present invention, to facilitate the initial process of filling the container with its original content, the cap engaging means is initially placed at a first position which prevents the cap engaging means from engaging the cap member, and a means is provided for moving the cap engaging means to a second position which is suitable for the cap engaging means to engage the cap member.

The objects of the present invention can be accomplished also by providing a container having means for preventing refilling, comprising: a tubular container main body having one end closed by an end wall provided with a content taking out opening; a piston member slidably received in the container main body so as to define a containing chamber between the piston member and the end wall; piston engaging means provided in the container main body and the piston member for engaging the piston member when the piston member has approached the end wall by more than a prescribed distance.

According to this structure employing the piston engaging member, when the piston member has approached the end wall of the container main body by more than a prescribed distance, the piston engaging member irreversibly engages the piston member so that the piston member is fixedly secured at this position, and refilling of the content into the containing chamber from the content taking out opening is made impossible.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
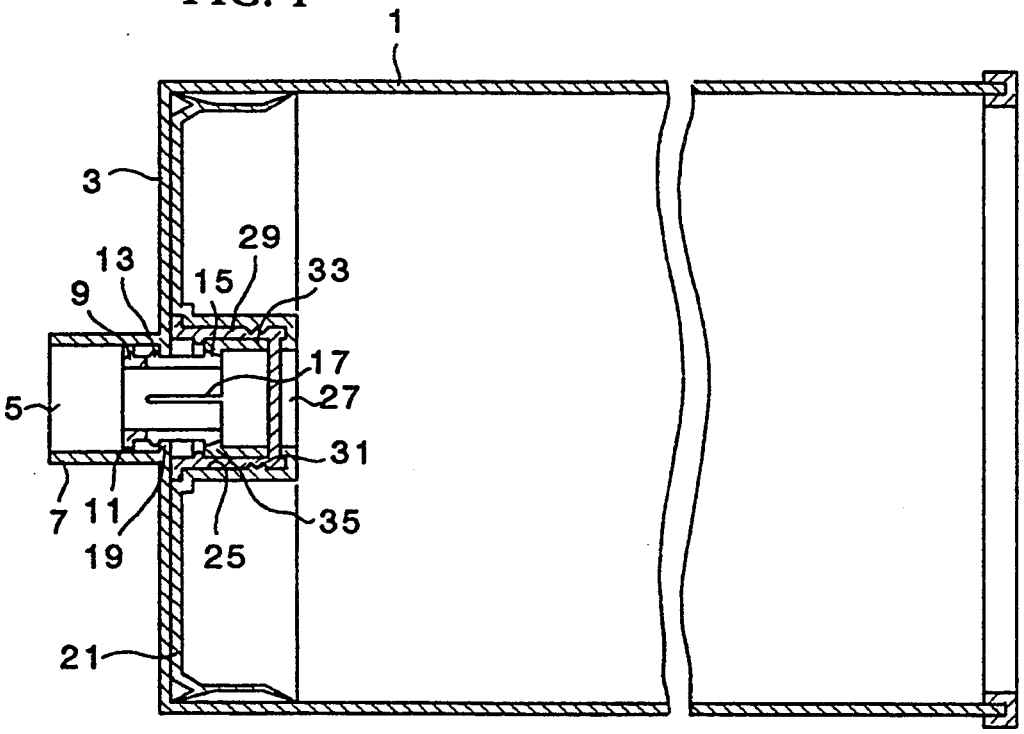
FIG. 1 is a vertical sectional view showing a first embodiment of the container having means for preventing refilling employing a cap engaging member in its initially filling position.

Now the preferred embodiments of the present invention are described in the following with reference to the appended drawings.

FIGS. 1 through 4 show an embodiment of the container having means for preventing refilling employing a cap engaging member. In these drawings, numeral 1 denotes a container main body. The container main body 1 consists of a tubular body having a left end thereof as seen in the drawings closed by an end wall 3, and the end wall is centrally provided with a tubular opening 7 which defines a content taking out opening 5.

A cap engaging tubular member 9 is internally received in the tubular opening 7. The cap engaging tubular member 9 comprises a flange portion 11 at its one end, a land portion 13 in its intermediate part, and a fluke-shaped engagement claw 15 around its other end or, in other words, around its forward end, the engagement claw 15 being elastically deformable in radial direction by being circumferentially separated from each other by slits 17 at its forward end.

Figure 2:
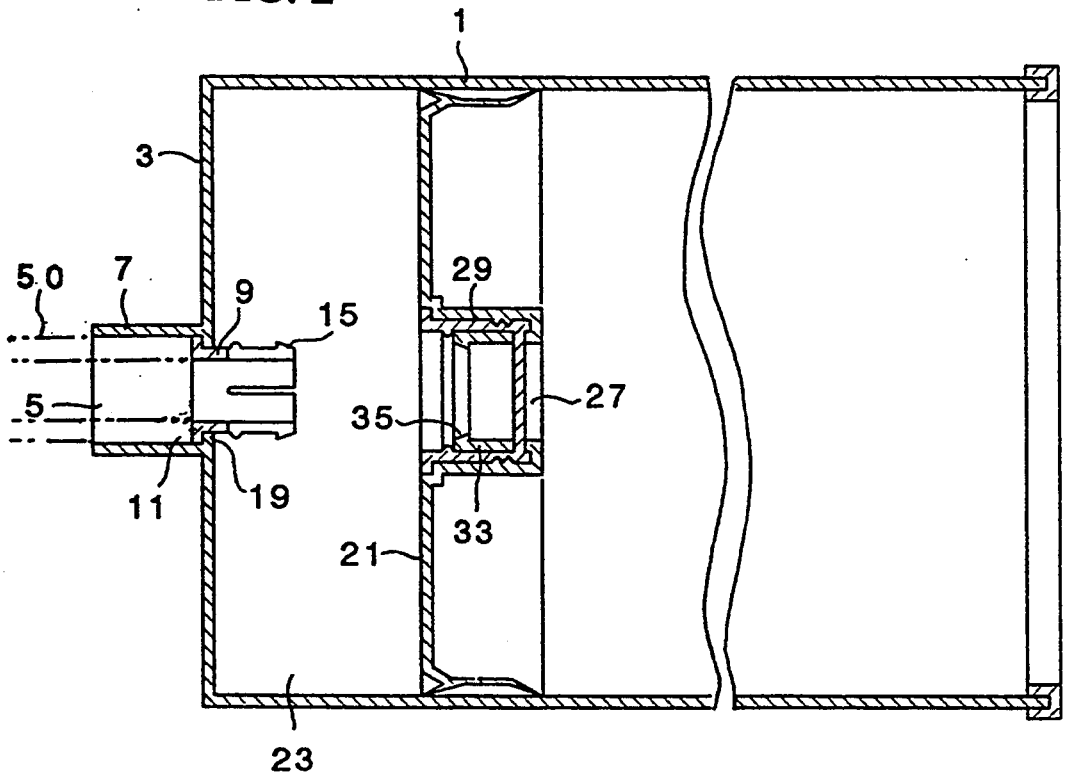
FIG. 2 is a vertical sectional view showing the first embodiment of the container having means for preventing refilling employing a cap engaging member in its normal position.
Figure 3:
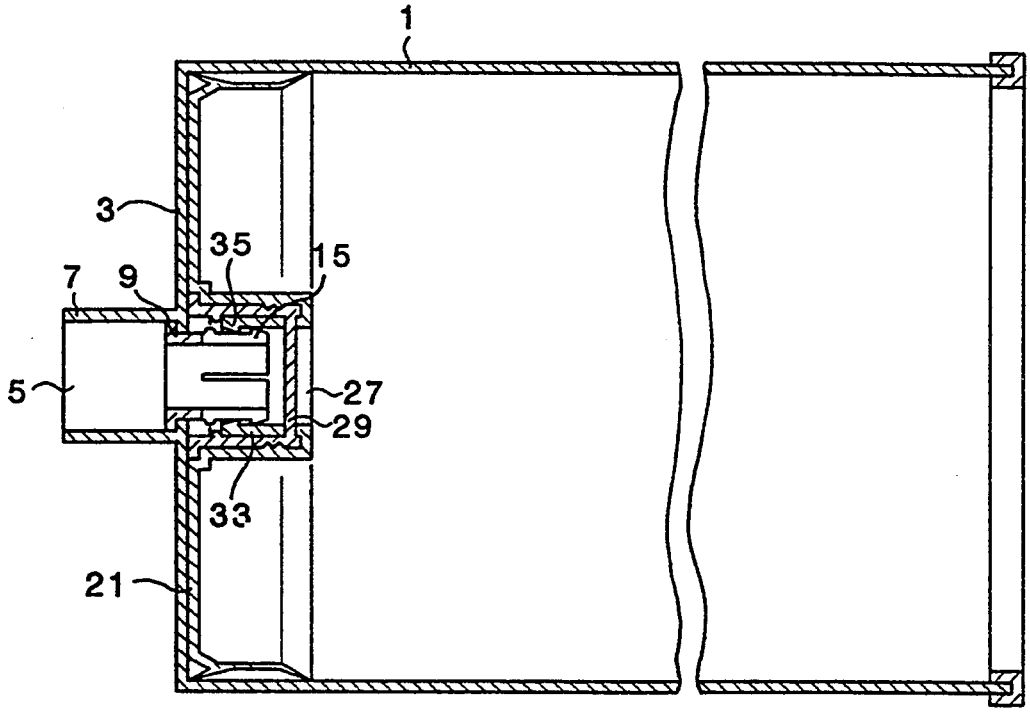
FIG. 3 is a vertical sectional view showing the first embodiment of the container having means for preventing refilling employing a cap engaging member in its used up condition.
Figure 4:
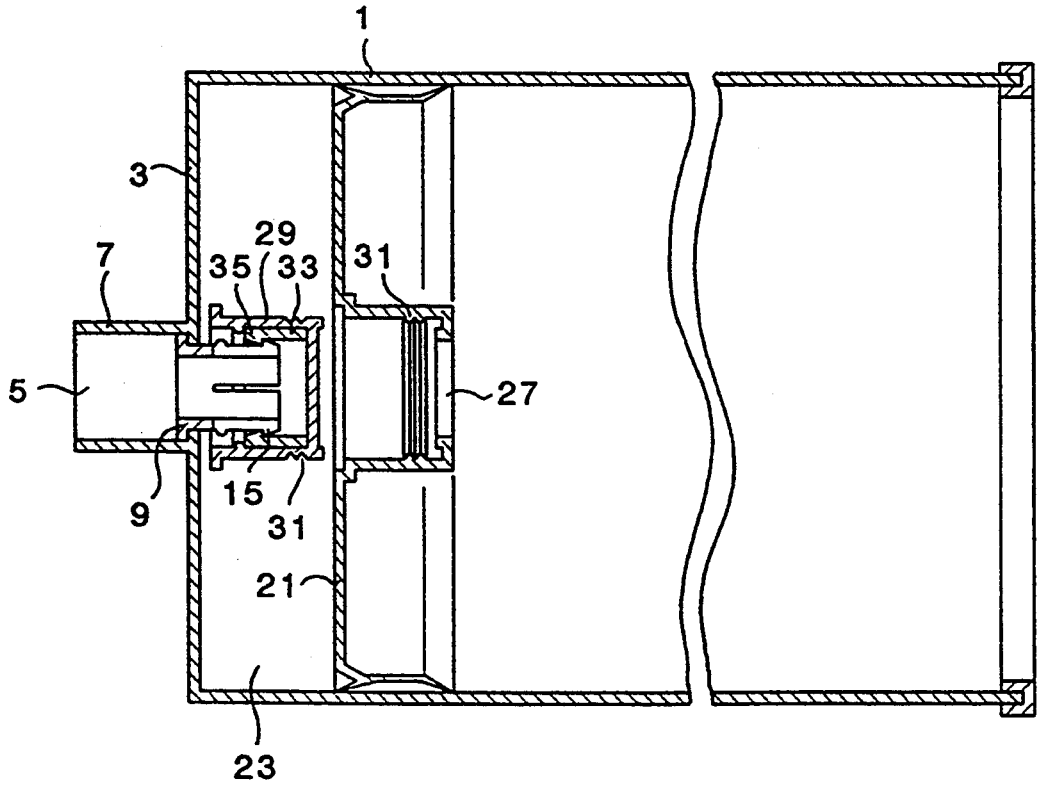
FIG. 4 is a vertical sectional view showing the first embodiment of the container having means for preventing refilling employing a cap engaging member while an attempt is being made to refill a content into this container.

The cap engaging tubular member 9 can move between an initially filling position in which the land portion 13 abuts a bottom portion 19 of the tubular opening 7 as illustrated in FIG. 1, and a normal position in which the flange portion 11 abuts the bottom portion 19 of the tubular opening 7 as illustrated in FIGS. 2 through 4, the projecting length of the engagement claw 15 from the end wall 3 being greater in the normal position than in the initial filling position.

A piston member 21 is axially slidably received in the container main body 1, and a containing chamber 23 is defined between the piston member 21 and the end wall 3. The piston member 21 is centrally provided with a recess 25, and an opening 27 is provided in a bottom portion of the recess 25.

A cap member 29 is fixedly fitted in the recess 25. The cap member 29 closes the opening 27 by being fitted into the recess 25 with a prescribed retaining force produced by a resistance imparting portion 31 so that the cap member 29 can be removed from the recess 25 and open up the opening 27 only when an axial force exceeding a prescribed value is applied thereto.

A tubular engagement claw member 33 is fixedly fitted into the cap member 29. The engagement claw member 33 may be integrally formed with the cap member 29, but in the illustrated embodiment, is formed as a member separate from the cap member 29 for the convenience of the molding process. An engagement claw 35 is provided in the inner circumferential surface of an end of the engagement claw member 33 to be irreversibly engaged by the engagement claw 15 provided in the cap engaging tubular member 9.

Referring to FIG. 1, when the cap engaging tubular member 9 is at its initial filling position, the amount of projection of the engagement claw 15 from the end wall 3 is so small that the engagement claw 15 of the cap engaging tubular member 9 cannot irreversibly engage the engagement claw 35 of the cap member 29 even when the piston member 21 is at its stroke end and abutting the end wall 3.

As a result, when the cap engaging member 9 is in this initial filling position, the cap member 29 is not engaged by the cap engaging tubular member 9 even when the piston member 21 is at its stroke end and abutting the end wall 3, and the piston member 21 can be moved to the right in the drawing with the opening 27 closed by the cap member 29 as a content is being filled into the containing chamber 23 from the content taking out opening 5. Thus, it is made possible to initially fill a content into the containing chamber 23 from the content taking out opening 5.

After the content has been initially filled into the container or during the use, a content taking out tube 50 provided in an external device is fitted into the tubular opening 7 as shown by the imaginary lines in FIG. 2, and the cap engaging member 9 is pushed to the right as seen in the drawings or at its normal position in which the flange portion 11 abuts the bottom portion 19 of the tubular opening 7 as illustrated in FIGS. 2 through 4.

The content filled in the containing chamber 23 is taken out from the content taking out opening 5 provided in the tubular opening 7, and the piston member 21 moves to the left as seen in the drawings or toward the end wall 3 as the content is taken out.

When the content is all taken out from the containing chamber 23, the piston member 21 reaches its stroke end, and abuts the end wall 3 as illustrated in FIG. 3. At this time, the engagement claw 15 of the cap engaging tubular member 9 fits into the engagement claw member 33, and irreversibly engages the engagement claw 35 of the engagement claw member 33. By this irreversible engagement between these two claws 15 and 35, the cap member 29 is held at this stroke end position.

When an attempt is made to refill a content into the containing chamber 23 from the content taking out opening 5 in this state, it causes the piston member 21 to move away from the end wall 3 as the content is filled, leaving the cap member 29 behind, as illustrated in FIG. 4, and the cap member 29 is removed from the recess 25 of the piston member 21, thereby opening up the opening 27 of the piston member 21. As a result, the content escapes from the opening 27, and refilling of the content into the containing chamber 23 is thus made impossible.

Figure 5:
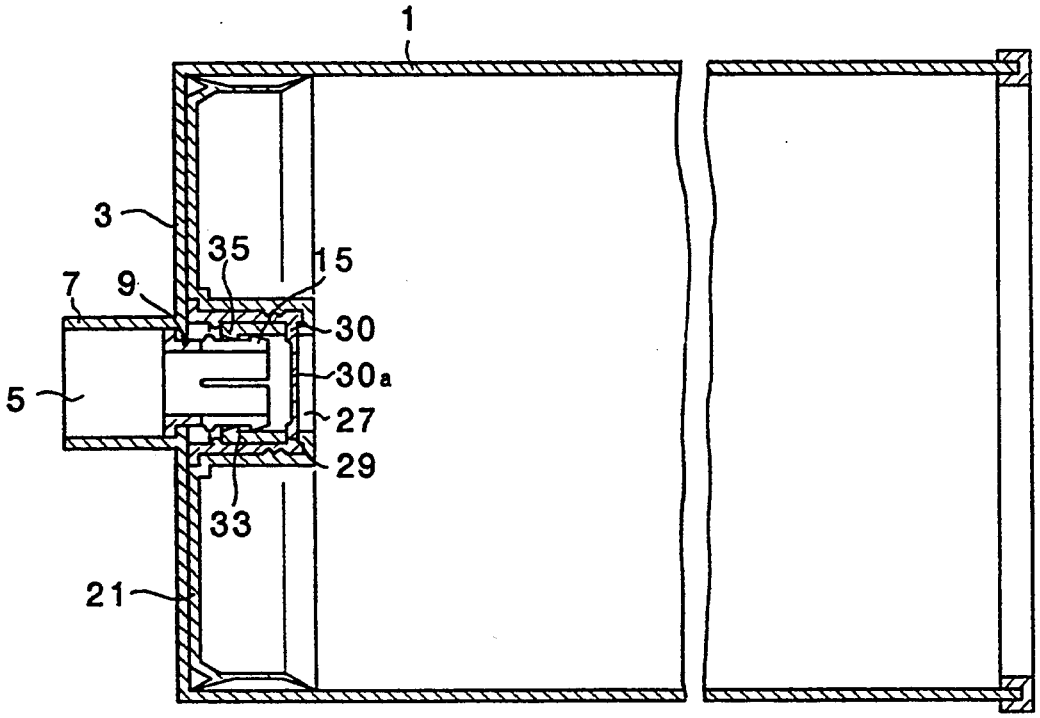
FIG. 5 is a vertical sectional view showing a second embodiment of the container having means for preventing refilling employing a cap engaging member and a breakable cap member in its normal position.
Figure 6:
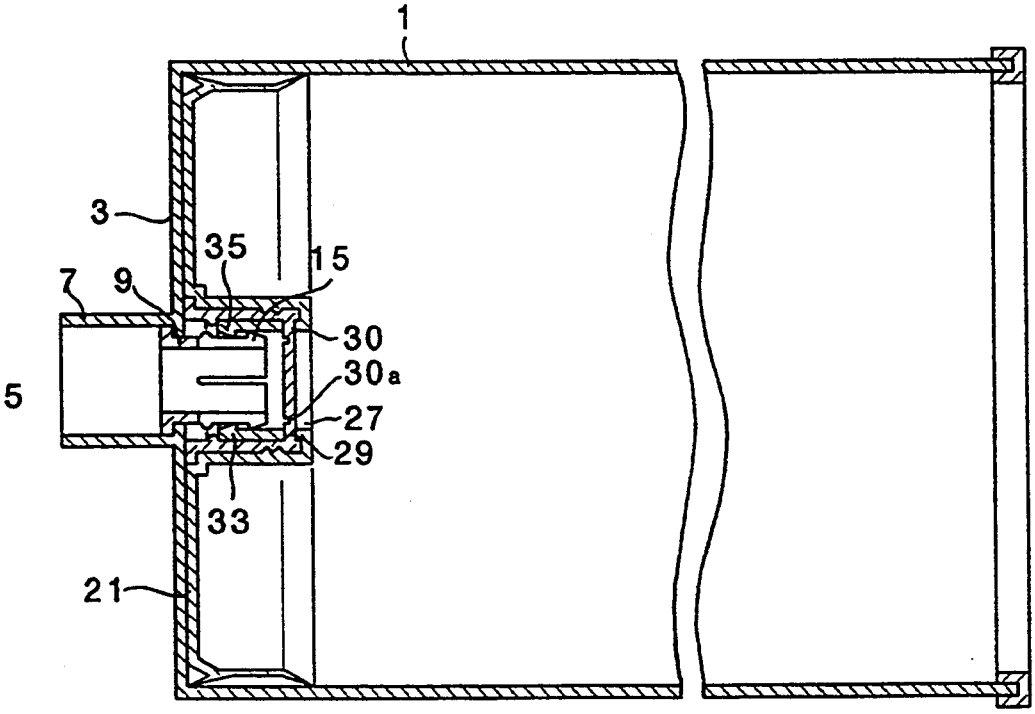
FIG. 6 is a vertical sectional view showing the second embodiment of the container having means for preventing refilling employing a cap engaging member and a breakable cap member in its used up condition.

FIGS. 5 and 6 show a second embodiment of the container having means for preventing refilling employing a cap engaging member and a breakable cap member according to the present invention. In FIGS. 5 and 6, the parts corresponding to those in FIGS. 1 through 4 are denoted with like numerals. In this embodiment, the cap member 29 substantially aligns with the content taking out opening 5 of the container main body 1, and substantially the entire bottom portion 30 of the cap member 29 is formed as a thin walled portion. The thin walled portion is denoted with numeral 30*a* in FIGS. 5 and 6. Alternatively, a thin walled substantially annular region may be provided around the side wall portion of the cap member 29.

According to this embodiment, in a fashion similar to the first embodiment, when the piston member 21 reaches its stroke end, and abuts the end wall 3, the engagement claw 15 of the cap engaging tubular member 9 is pushed into the engagement claw member 33, and irreversibly engages with the engagement claw 35 of the engagement claw member 33. As a result, the cap member 29 is retained at this stroke end position.

In this state, if an attempt is made to push back the piston member 21, for instance, by inserting a rod into the content taking out opening 5, the forward end of the rod will push the bottom portion 30 of the cap member 29. As a result, a force large enough to break the thin walled portion 30*a* will be applied to the bottom wall 30, and rip apart the bottom portion 30. As a result, the content escapes from the ripped-apart bottom portion 30 of the cap member 29, and refilling of the content into the containing chamber 23 is thus made impossible.

Figure 7:
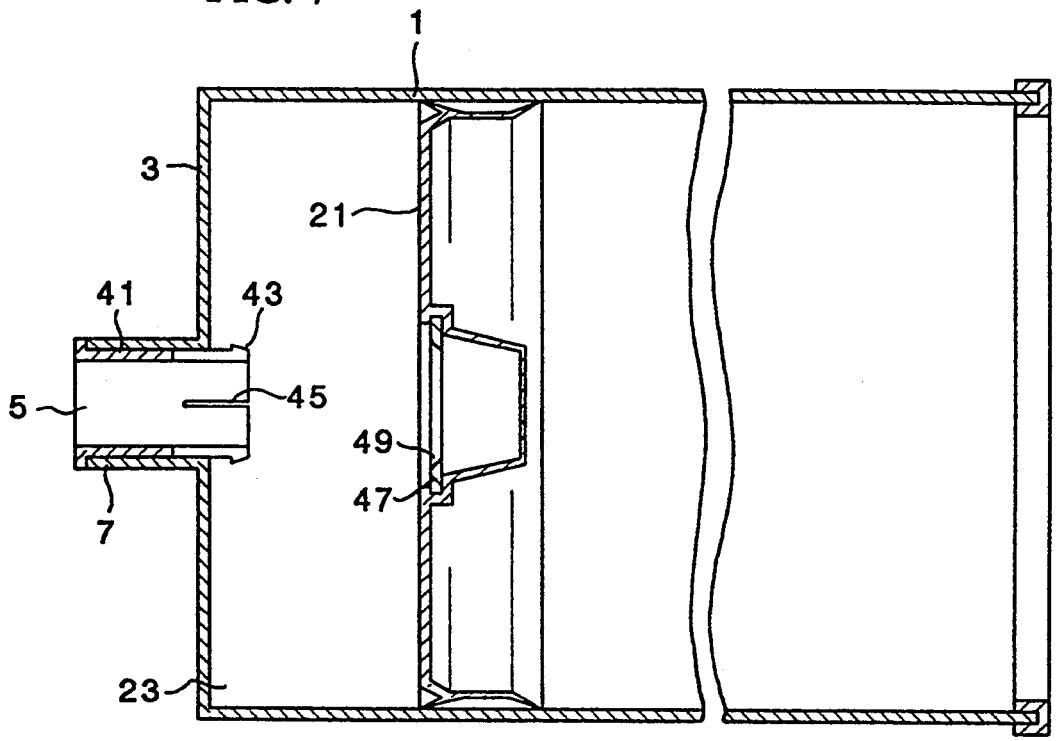
FIG. 7 is a vertical sectional view showing a third embodiment of the container having means for preventing refilling employing a piston engaging member in its normal position.
Figure 8:
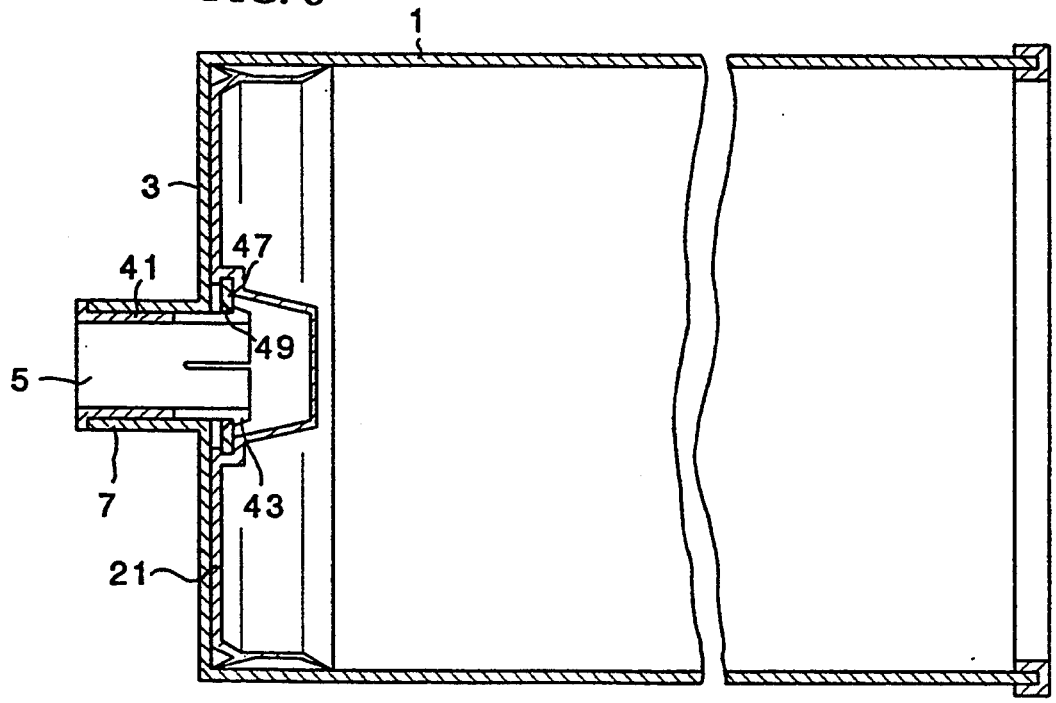
FIG. 8 is a vertical sectional view showing the third embodiment of the container having means for preventing refilling employing a piston engaging member in its used up condition.

FIGS. 7 and 8 show a third embodiment of the container having means for preventing refilling employing a piston engaging member according to the present invention. In FIGS. 5 and 6, the parts corresponding to those in FIGS. 1 through 6 are denoted with like numerals.

In this embodiment, a piston engaging tubular member 41 is internally received in the tubular opening 7. The piston engaging tubular member 41 is similar to the cap engaging tubular members 9 of the previous embodiments, and is provided with an engagement claw 43 around its forward end, and is capable of elastic deformation in radial direction by being circumferentially separated by slits 45 at its forward end.

An annular engagement claw member 47 is fixedly fitted on the piston member 21. The engagement claw member 47 is formed with an engagement claw 49 which irreversibly engages with the engagement claw 43 of the piston engaging tubular member 43.

In this embodiment, when the content in the containing chamber 23 has been all taken out, and the piston member 21 is at its stroke end and abutting the end wall 3 as illustrated in FIG. 8, the engagement claw 43 of the piston engaging tubular member 41 fits into the engagement claw member 47, and irreversibly engages with the engagement claw 49. This irreversible engagement holds the piston member 21 at its stroke end, and thereafter prevents the piston member 21 from moving rightward any more.

Thus, once the piston member 21 reaches its stroke end, it becomes impossible to refill a content into the containing chamber 23 from the content taking out opening 5.

As can be understood from the above description, according to the container having means for preventing refilling, when the piston member approaches the end wall of the container main body by more than a prescribed distance, the cap engaging member irreversibly engages the cap member, and retains the cap member at this position. When an attempt is made to refill a content into the containing chamber from the content taking out opening in this condition, the piston member moves away from the end wall as this refilling process progresses, and this causes the cap member to be removed from the piston member, and opens up the opening of the piston member. As a result, the content starts escaping from this opening. Alternatively, when the piston member approaches the end wall of the container main body by more than a prescribed distance, the piston engaging member irreversibly engages the piston member, and retains the piston member at this position. In either case, refilling of the content into the containing chamber from the content taking out opening is made impossible. Thus, simply by providing an irreversible claw engagement structure in a cylinder/piston type container, one can obtain a container having means for preventing refilling without complicating its structure which is so simple in structure and easy to manufacture that it can be used as a disposable container.

In the case of the embodiment employing means for engaging the piston member, if the portion of the piston member which may be pushed by a rod or the like in an attempt to disengage the piston is formed so as to be breakable, it is possible to even more positively prevent an attempt to refill the container.

Although the present invention has been described in terms of specific embodiments thereof, it is possible to modify and alter details thereof without departing from the spirit of the present invention.

What we claim is:

1. A container having means for preventing refilling, comprising:

a tubular container main body having one end closed by an end wall provided with a content taking out opening;

a piston member slidably received in said container main body so as to define a containing chamber between said piston member and said end wall;

a cap member detachably mounted on said piston member and closing an opening provided in said piston member, said opening communicating said containing chamber with an external part; and cap engaging means provided in said container main body for engaging said cap member when said piston member has approached said end wall by more than a prescribed distance.

2. A container according to claim 1, wherein said cap member comprises a breakable part for preventing intact disengagement of said cap member from said cap engaging means.

3. A container according to claim 2, wherein said cap member comprises a tubular side wall, and a bottom portion closing one end of said tubular side wall, said bottom portion including a breakable thin-walled portion.

4. A container according to claim 2, wherein said cap member comprises a tubular side wall, and a bottom portion closing one end of said tubular side wall, said side wall including a substantially annular breakable thin-walled portion.

5. A container according to claim 1, wherein said cap engaging means is initially placed at a first position wherein said cap engaging means is prevented from engaging said cap member, said container further provided with a means for moving said cap engaging means to a second position wherein said cap engaging means is able to engage said cap member.

6. A container having means for preventing refilling, comprising:

a tubular container main body having one end closed by an end wall provided with a content taking out opening;

a piston member slidably received in said container main body so as to define a containing chamber between said piston member and said end wall;

piston engaging means provided in said container main body and said piston member for engaging said piston member when said piston member has approached said end wall by more than a prescribed distance, at which point said piston member is adjacent said end wall, said piston engaging means not engaging with said piston member until said piston member has approached said end wall by more than said prescribed distance.

* * * * *